US007905549B2

(12) United States Patent
Lake et al.

(10) Patent No.: US 7,905,549 B2
(45) Date of Patent: Mar. 15, 2011

(54) HIGHCHAIR

(75) Inventors: Jon Lake, Sunnyvale, CA (US); Davy Kho, Paris (FR); Jason Lewis, Sai Kung (HK)

(73) Assignee: iLinko Ltd., Quarry Bay (HK)

( * ) Notice: Subject to any disclaimer, the term of this patent is extended or adjusted under 35 U.S.C. 154(b) by 316 days.

(21) Appl. No.: 11/942,685

(22) Filed: Nov. 19, 2007

(65) Prior Publication Data

US 2008/0179923 A1 Jul. 31, 2008

(30) Foreign Application Priority Data

Nov. 17, 2006 (DE) ..... 20 2006 017 553 U

(51) Int. Cl.
*A47C 1/00* (2006.01)

(52) U.S. Cl. ..... 297/344.19; 297/344.22; 297/327; 297/423.25; 297/423.38; 297/463; 297/153

(58) Field of Classification Search ..... 297/344.19, 297/344.22, 327, 423.25, 423.38, 463.1, 297/463.2, 153
See application file for complete search history.

(56) References Cited

U.S. PATENT DOCUMENTS

| | | | | | |
|---|---|---|---|---|---|
| 54,217 | A | * | 4/1866 | Sargent | 297/327 |
| 699,889 | A | | 5/1902 | Morsell | |
| 1,542,508 | A | * | 6/1925 | Koenigkramer | 297/300.5 |
| 1,999,848 | A | * | 4/1935 | Ries | 60/442 |
| 2,609,862 | A | * | 9/1952 | Pratt | 297/344.19 |
| 2,779,389 | A | * | 1/1957 | Pearl | 297/327 |
| 2,904,102 | A | * | 9/1959 | Komori | 297/250.1 |
| 3,450,433 | A | * | 6/1969 | Ballard | 297/354.12 |
| 3,589,772 | A | | 6/1971 | Leaver | |
| 3,891,270 | A | * | 6/1975 | Crossman et al. | 297/344.19 |
| 3,975,050 | A | * | 8/1976 | McKee | 297/328 |
| 5,527,096 | A | * | 6/1996 | Shimer | 297/327 |
| 5,890,764 | A | * | 4/1999 | Lee | 297/344.22 |
| 5,984,409 | A | * | 11/1999 | Eakin et al. | 297/327 |

(Continued)

FOREIGN PATENT DOCUMENTS

DE 40 37 869 A1 11/1991

(Continued)

OTHER PUBLICATIONS

European Patent Office Search Report, dated Apr. 16, 2008, issued in corresponding European Application No. 07022293.0-2313, filed Nov. 16, 2007.

European Search Report mailed Sep. 13, 2010, issued in corresponding European Application No. EP 07022293, filed May 21, 2008, 2 pages.

*Primary Examiner* — Laurie K Cranmer
(74) *Attorney, Agent, or Firm* — Christensen O'Connor Johnson Kindness PLLC

(57) ABSTRACT

A highchair with a foot part and a seat element mounted thereon has a length-adjustable gas-filled strut therebetween for support and height adjustment of the seat element. The gas-filled strut may be length adjustable with two-handed safety operation. The seat element is held on two lateral support arms, on each of which an actuating element of the two-handed safety operation is arranged. Each actuating element is connected via a wire or rope pull to a pressure element acting on an actuating projection of the gas-filled strut. The seat element is pivotable and fixable about a horizontal transverse axis forwards and backwards in a tilting position. An inclination catch is provided on at least one support arm and has a rotary locking element acting between a spindle of the seat element and a support arm, which is transferable into a locking or release position by means of an actuation cam.

39 Claims, 7 Drawing Sheets

U.S. PATENT DOCUMENTS

| | | | | |
|---|---|---|---|---|
| 6,033,019 | A * | 3/2000 | Hession-Kunz et al. | 297/250.1 |
| 6,056,362 | A * | 5/2000 | de la Haye | 297/314 |
| 6,347,833 | B1 * | 2/2002 | Chen | 297/328 |
| 6,398,304 | B1 * | 6/2002 | Chen et al. | 297/327 |
| 6,500,072 | B1 * | 12/2002 | Myers et al. | 472/119 |
| 6,578,496 | B2 * | 6/2003 | Guard et al. | 108/25 |
| 6,877,811 | B1 * | 4/2005 | Garelick | 297/344.22 |
| 7,185,949 | B2 * | 3/2007 | Finell | 297/148 |
| 7,419,210 | B2 * | 9/2008 | Nolan et al. | 297/153 |
| 2004/0036333 | A1 | 2/2004 | Lin | |

FOREIGN PATENT DOCUMENTS

| | | | |
|---|---|---|---|
| DE | 19501461 | A1 | 3/1996 |
| DE | 20307192 | U1 | 9/2003 |
| EP | 0 128 339 | A2 | 12/1984 |
| GB | 2 391 465 | A | 2/2004 |
| GB | 2401097 | A * | 11/2004 |
| GB | 2 407 487 | A | 5/2005 |
| GB | 2407487 | A * | 5/2005 |
| GB | 2 412 306 | A | 9/2005 |

* cited by examiner 82
80
78
74
24

88
86
70
78
82
86
74
84
90
24

94
90
24

92
72
90

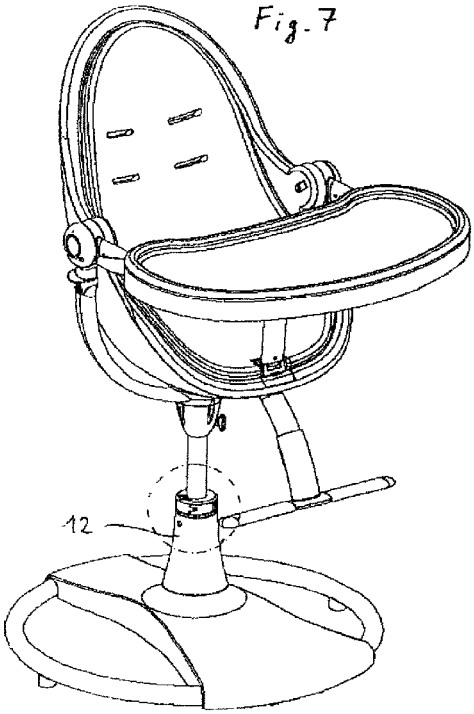
Fig. 7
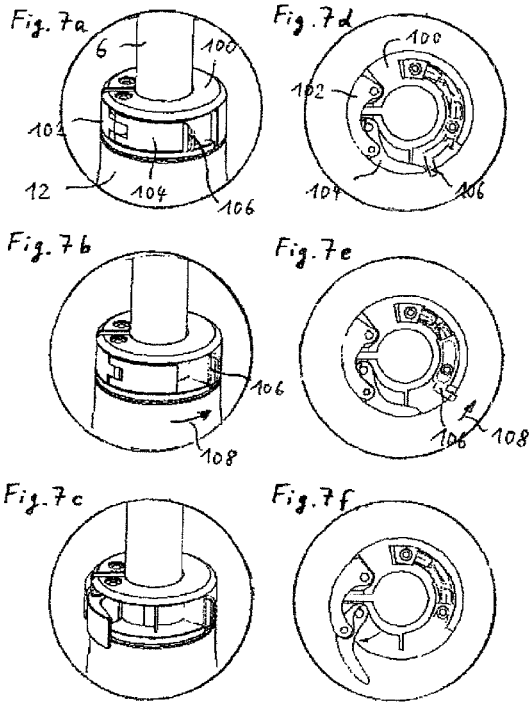

82
126
134
132

134
130
132

120
122
124

120
33
32

33

32
34
142
30
150
148
144
146
140

HIGHCHAIR

BACKGROUND

The present application relates generally to a highchair with a foot part and a seat element mounted thereon.

Such a highchair is known for example from GB 2 407 487 A. This construction, however, has disadvantages in that the foot part is made up of many individual elements. In addition, narrow limits are placed on the adjustability of the highchair.

SUMMARY

In various embodiments, disclosed herein is an improved highchair, distinguished by a simple, clear, and at the same time secure construction and easy adjustability.

In a first aspect, a highchair with a foot part and a seat element mounted thereon includes a single vertically arranged, length-adjustable gas-filled strut that provides support and height adjustment of the seat element between foot part and seat element. In addition, the gas-filled strut is provided with two-handed safety operation. The seat element is preferably held on two lateral support arms, on each of which an actuating element of the two-handed safety operation is arranged. Each actuating element can be connected by a wire or rope pull to a pressure element acting on an actuating projection of the gas-filled strut.

In another aspect, disclosed herein is a highchair with a foot part and a seat element mounted thereon, wherein the seat element can be pivoted and secured about a horizontal transverse axis backwards and forwards in a tilting position. The seat element is appropriately swivel-mounted on two lateral support arms and the transverse axis, whereby an inclination catch is provided on at least one support arm. The inclination catch preferably has a rotary locking element acting between a spindle of the seat element and a support arm, which can be brought into a locked or release position by means of an actuation cam.

The rotary locking element can cooperate with the spindle in a torque-proof manner and shift longitudinally via a longitudinal groove or wedge teeth. The rotary locking element may have radially or axially aligned locking teeth, which can be engaged with corresponding locking teeth, connected solidly to the support arm. An actuating element can be arranged on a rear side of the seat element and be connected to a wire or rope pull cooperating with the actuation cam.

A table can be held horizontally on the lateral support arms, whereby a telescopic safety support is arranged to shift lengthways between a leading edge of the seat element and the table. Furthermore, the safety support may be held on the seat element by a fixing mechanism detachable by hand. A detachable snap-in connection can be provided by means of pressure actuation. The table can be held detachably with two snap-in fixing catches on the support arms.

In a further aspect, disclosed herein is a highchair with a foot part and a seat element mounted thereon, wherein the seat can be pivoted and secured about a vertical axis relative to the foot part. The seat element can be rotated through 360°. A cylindrical lifting lug of the seat part is mounted effectively in a hollow-cylindrical recess of the foot part. The recess can be provided with a C-shaped clamp ring enclosing the lifting lug. The clamp ring can be tensed and detached by means of a knee lever mechanism engaging on at least one of its free ends. It can also be provided for the knee lever mechanism to have a detaching safety device acting in a closed state.

Additionally, disclosed herein is a height-adjustable footrest that is held on the seat part, which can be adjusted by means of actuating a knob. A table can be held detachably and horizontally on the lateral support arms. A substitute table top, for example a table top that is larger or differently shaped or provided with another surface, can be detachably snapped onto the table.

The foot part may have an annular part with a central transverse element on which the seat element is held. The transverse element can be designed monobloc with a hollow-cylindrical recess for a lifting lug of the seat element or respectively a gas-filled strut. The transverse element can be designed as a plastic molded article.

The foregoing summary introduces a selection of concepts in a simplified form that are further described below in the Detailed Description. This summary is not intended to specify key features of the claimed subject matter, nor is it intended to be used to determine the scope of the claimed subject matter.

DESCRIPTION OF THE DRAWINGS

Further advantages and characteristics of the invention will emerge from the following description of an embodiment, whereby reference is made to the drawings, in which.

DETAILED DESCRIPTION

Figure 1:
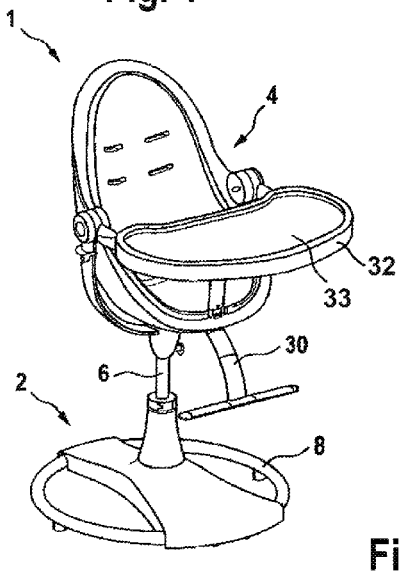
FIG. 1 and FIG. 1*a* to 1*g* show an inventive highchair and its associated components.
Figure 1A:
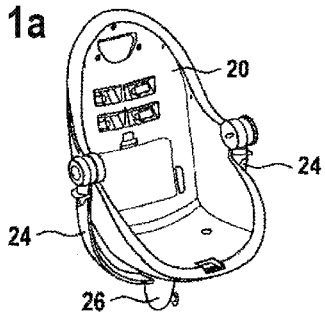
Figure 1B:
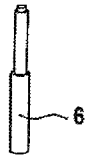
Figure 1C:
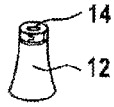
Figure 1D:
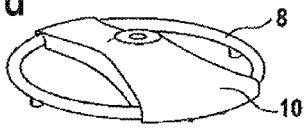
Figure 1E:
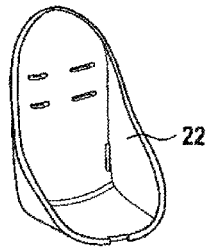
Figure 1F:
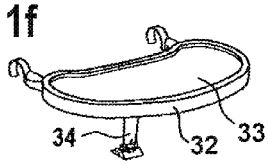
Figure 1G:
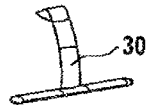

Reference is first made to FIG. 1 and FIG. 1*a* to FIG. 1*g*, in which the basic structure of an embodiment of the inventive highchair is illustrated. The highchair 1 has a foot part 2 and a seat element 4, interconnected rotatably and height-adjustably by a gas-filled strut 6 arranged therebetween.

In the illustrated embodiment, the foot part 2 is built substantially from a ring 8 made of bent metallic tubing and a plastic transverse element 10 connected firmly to the latter, on which a holding part 12 with a cylindrical receiving opening 14 is centrally arranged for receiving a lower end section of the gas-filled strut 6.

In the illustrated embodiment, the seat element 4 is built substantially from a seating shell 20 with a backrest 22 contained therein, whereby the seating shell 20 is laterally held on two support arms 24 bent approximately into a quarter circle shape. The support arms 24 are interconnected by a connector 26 that serves at the same time to connect to an upper end section of the gas-filled strut 6. A footrest 30 is detachably affixed to the seating shell 20.

A table 32, having, in one embodiment, a detachable substitute table top 33, is also detachably attached to upper end sections of the support arms 24, from which a safety support 34 extends downwards to a front edge of the seating shell 20 and is detachably connected to the latter.

Figure 2:
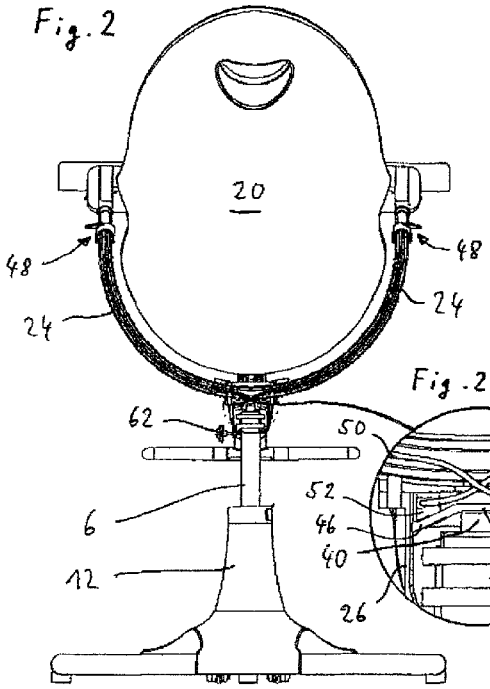
FIG. 2, FIG. 2*a* and FIG. 3, FIG. 3*a* illustrate height adjustment of the highchair according to FIG. 1, FIG. 4, FIG. 5, FIG. 6 and FIGS. 6*a* to 6*d* illustrate the tilt adjustability of the highchair according to FIG. 1, FIG. 7 and FIGS. 7*a* to 7*f* illustrate the turning range of a highchair according to FIG. 1 about a vertical axis of rotation.
Figure 2A:
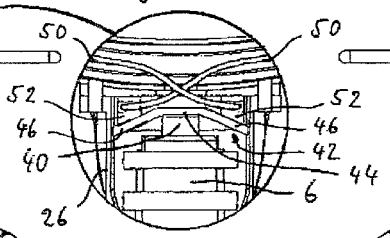
Figure 3:
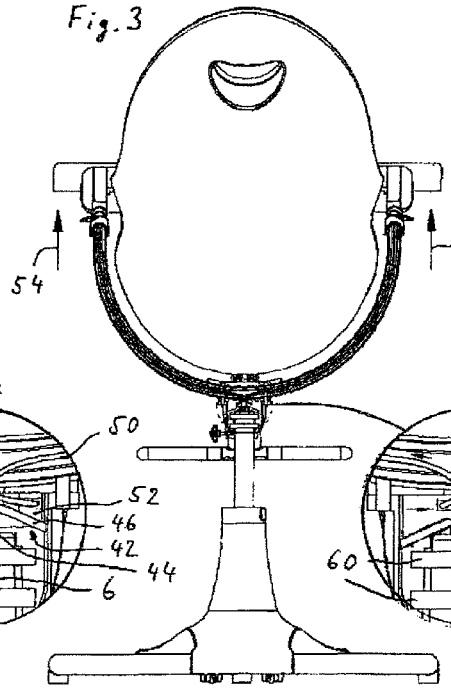
Figure 3A:
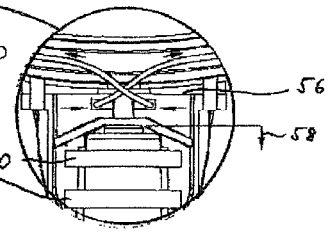

FIG. 2 and FIG. 3 illustrate the height adjustability of the highchair 1 in greater detail. Standing upright on the gas-filled strut 6 on its upper end section is an actuating projection 40 (FIG. 2*a*), which enables height or respectively length adjustment of the gas-filled strut 6 in the low-pressure state (FIG. 3*a*). Provided for this purpose is an angled pressure element 42 acting on the actuating projection 40. The angled pressure element 42 rests on the actuating projection 40 with a horizontal central section 44 and has two end sections 46 angled downwards. Arranged displaceably on each support arm 24 is an actuating element 48 connected to an end of a rope or wire pull 50, which is in each case connected at its other end in the region of the pressure element 42 to a wedge-shaped slide element 52.

Whenever both actuating elements 48 are pulled up at the same time, as indicated by arrows 54 in FIG. 3, the slide elements 52 are drawn to each other by the wire pulls 50 in the direction of the middle section 44 of the pressure element 42. The slide elements 52 press down the pressure element 42, as indicated by arrow 58, since the slide elements 52 are supported in the vicinity of their top side on a flat guide face 56.

Two-handed safety operation is obtained by using two separately acting wire pulls 50 and an angled pressure element 42, which prevents the height adjustment from being activated unwantedly by a small child sitting in the child seat. Actuation of only one wire pull is not enough.

FIG. 2 and FIG. 3 further show the mounting of the upper end section of the gas-filled strut 6 in the connecting part 26 of the seat element 4. Arranged in the connecting part 26 are two bearing bush-like receiving elements arranged at a mutual distance 60, whereof the inner diameter corresponds to the outer diameter of the gas-filled strut 6. A fixing screw 62 fitted with a handgrip can be tightened laterally against the gas-filled strut 6 to brace and fix the position of the seat element 4 relative to the gas-filled strut 6.

Figure 4:
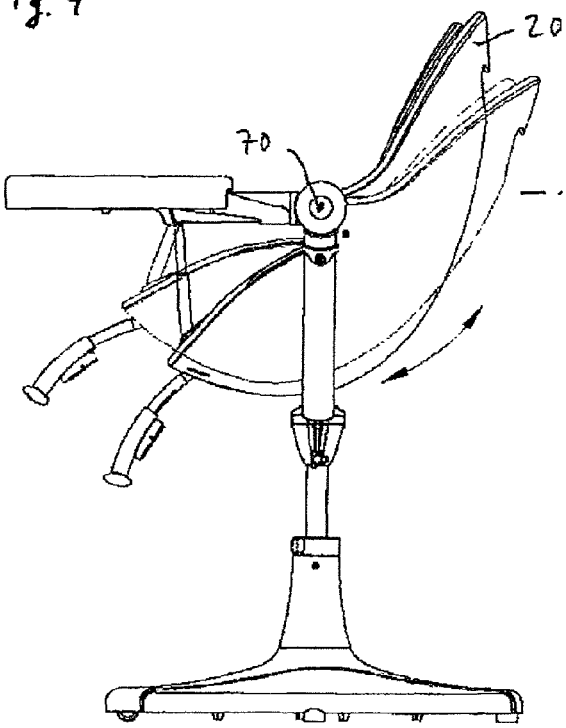
Figure 5:
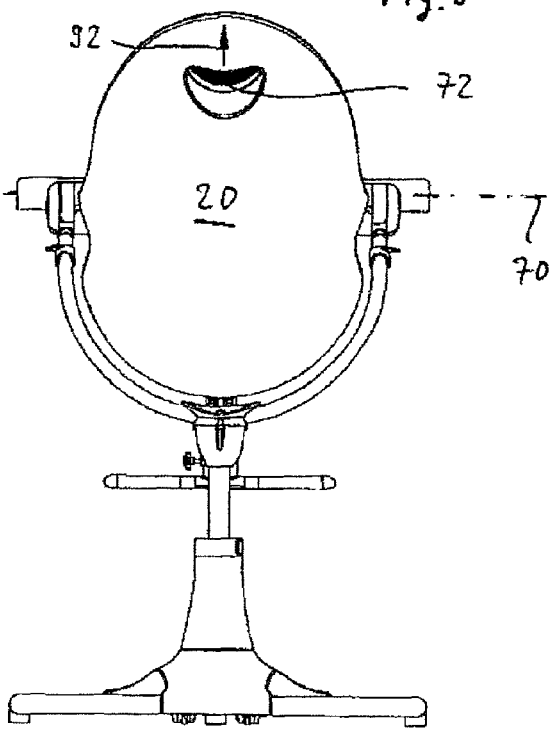

FIG. 4 and FIG. 5 illustrate the possibility of pivoting the seat element 4 or respectively the seating shell 20 about a horizontal transverse axis 70 and in this way setting the tilt of the seating shell 20. A hand-activated actuating element 72 is arranged on the back of the seating shell for this purpose.

Figures 6, 6A, 6B, 6C, 6D:
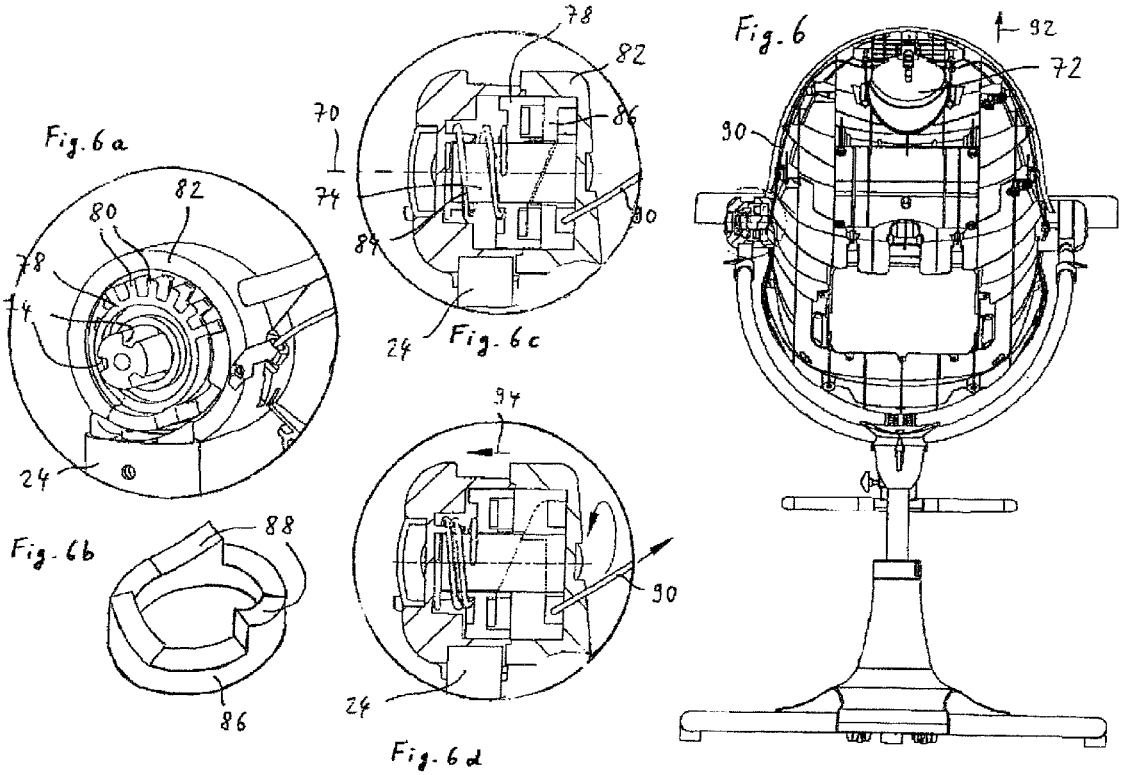

FIG. 6 and details according to FIG. 6*a* to FIG. 6*d* illustrate the locking of the seating shell 20 at a preferred tilt. The seating shell 20 is fitted with two lateral spindles 74 fixing the transverse axis 70, in which longitudinal grooves 76 are designed. Arranged axially and displaceably on each spindle 74 is a rotary locking element 78 which engages with radially inwardly aligned projections in the longitudinal grooves 74, so that the rotary locking element 78 is connected torque-proof to the spindle 74. The rotary locking element 78 is also fitted with locking teeth 80, with which it can positively engage with complementary locking projections or teeth, which are designed on the inside in a bearing bushing 82, in turn connected firmly to the respective support arm 24. Arranged between the rotary locking element 78 and the bearing bushing 82 on one side is a screw-shaped reset spring 84 and on the other side a rotary cam element 86, which is provided with three wedge-shaped rising cams or guide faces 88, arranged distributed over its periphery. The rotary locking element 78 is fitted with counter-faces (not illustrated here), which cooperate with the cams 88.

The rotary cam element 86 is arranged rotatably on the spindle 74 and is connected to the operating element 72 by suitable actuation means, in this example by a wire pull 90. The rotary locking arrangement shown in FIG. 6*a* to FIG. 6*d* is appropriately present similarly on both sides of the seating shell 20.

When the actuation element 72 is activated in the direction of the arrow 92, the rotary cam element 86 is rotated through a preset angle, and in the process moving the rotary locking element 78 guided torque-proof on the spindle 74 against the force of the reset spring 84 outwards in the direction of the arrows 94. The locking teeth 80 of the rotary locking element 78 disengage from the locking teeth of the bearing bushing 82, so that the seating shell 20 can be pivoted freely about the transverse axis 70. When a preferred inclination is reached, the operating element 72 is released and the reset spring 84 brings the rotary locking element 78 back into locking engagement with the bearing bushing 82, so that both the spindle 74 and the seating shell 20 are held opposite the support arms 24 such that they cannot rotate.

FIG. 7 and FIG. 7*a* to FIG. 7*f* illustrate how the seat element of the highchair opposite the foot part is held rotatable and fixed about a vertical axis 96. For this purpose, a C-shaped clamp ring 100 is provided in or respectively on the holding part 12 of the foot part 2, whereof opposing ends can be tensed by means of a knee lever or over-dead point lever arrangement in the direction of one another. In the illustrated embodiment, the knee lever arrangement is built from a tension lever 102 and an actuation lever 104, which are connected to the clamp ring 100 and to each other.

In the position illustrated in FIG. 7*a*, FIG. 7*b*, FIG. 7*d*, and FIG. 7*e*, the clamp ring 100 is tensed firmly on the lower end section of the gas-filled strut 6, so that the latter and the seat element 4 cannot rotate relative to the foot part 2. If the actuating lever 104 is loosened (FIG. 7*c*, FIG. 7*f*), the clamp ring 100 releases the gas-filled strut 6, and the seat element 4 can be rotated.

A safety slide 106, which can move in a peripheral direction, assumes a spring-loaded starting position as illustrated in FIG. 7*a* and FIG. 7*d*, in which the actuating lever 104 cannot be gripped from behind, thus preventing accidental actuation by children. Only moving the safety slide 106 back in the direction of arrow 108 (FIG. 7*b*, FIG. 7*e*) allows the actuating lever 104 to open.

Figures 8, 8A, 8B, 8C, 8D:
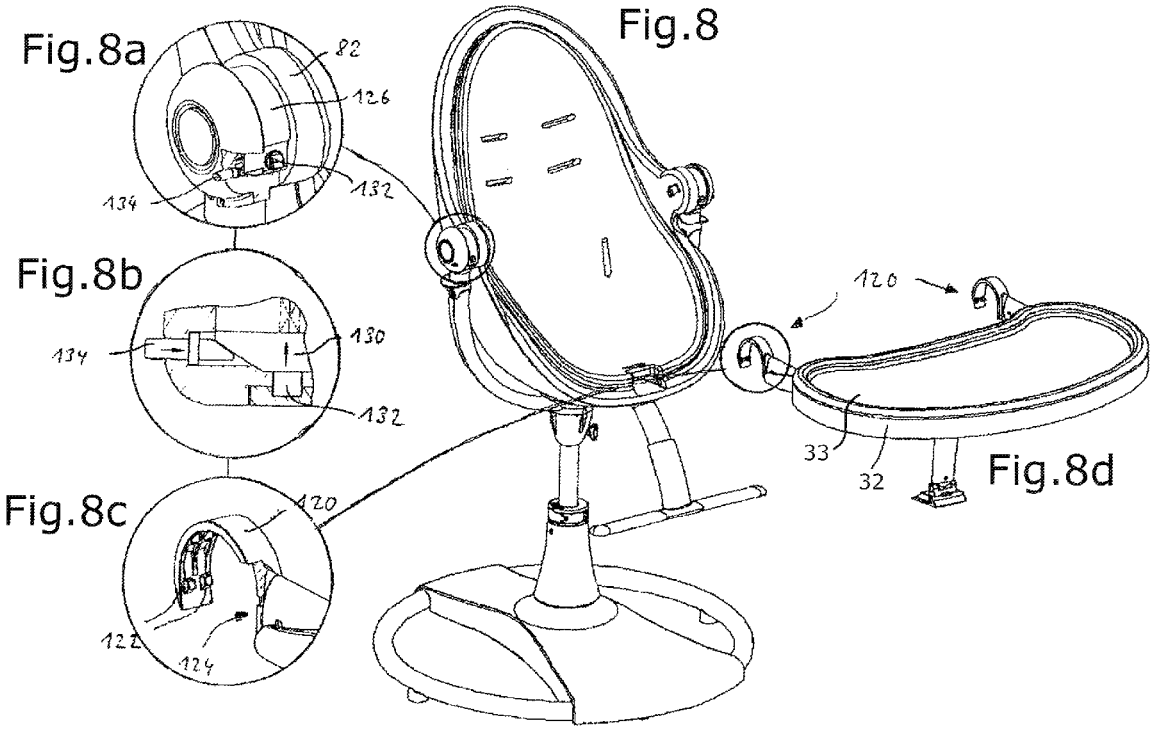
FIG. 8 and FIGS. 8*a* to 8*d* illustrate the fixing of a table to the highchair.

FIG. 8 and FIG. 8*a* to FIG. 8*d* illustrate the fastening of the table 32 to the support arms 24. As FIG. 8*c* shows, the table 32 has two hook-shaped fixing catches 120 that are fitted on the inside with two locking lugs 122 and, opposite these, with a locking recess (not illustrated in detail), the position of which is designated by 124. The bearing bushings 82 held on the upper ends of the support arms 24 are fitted on the outside with groove-like depressions 126, in which the fixing catches 120 are inserted.

In each bearing bushing 82, a spring-loaded latch element 130 (FIG. 8*b*) is slidably mounted and bears a latching lug 132. The spring-loaded latch element 130 can be actuated by a pushbutton 134 from the outside so that the latching lug 132 in the bearing bushing 82 can be moved back.

When the fixing catch 120 is set on the bearing bushings 82 or respectively in the depressions 126, the locking lugs 122 engage in corresponding depressions (not shown) in the bearing bushing 82, and the latching lugs 132 snap into the locking recesses 124, so that the table is held firmly on the support arms 24. To release the table 32, the pushbuttons 134 are actuated so that the latching lugs 132 pull back and the fixing catches 120 can be released.

Figures 9, 9A, 9B, 9C, 9D:
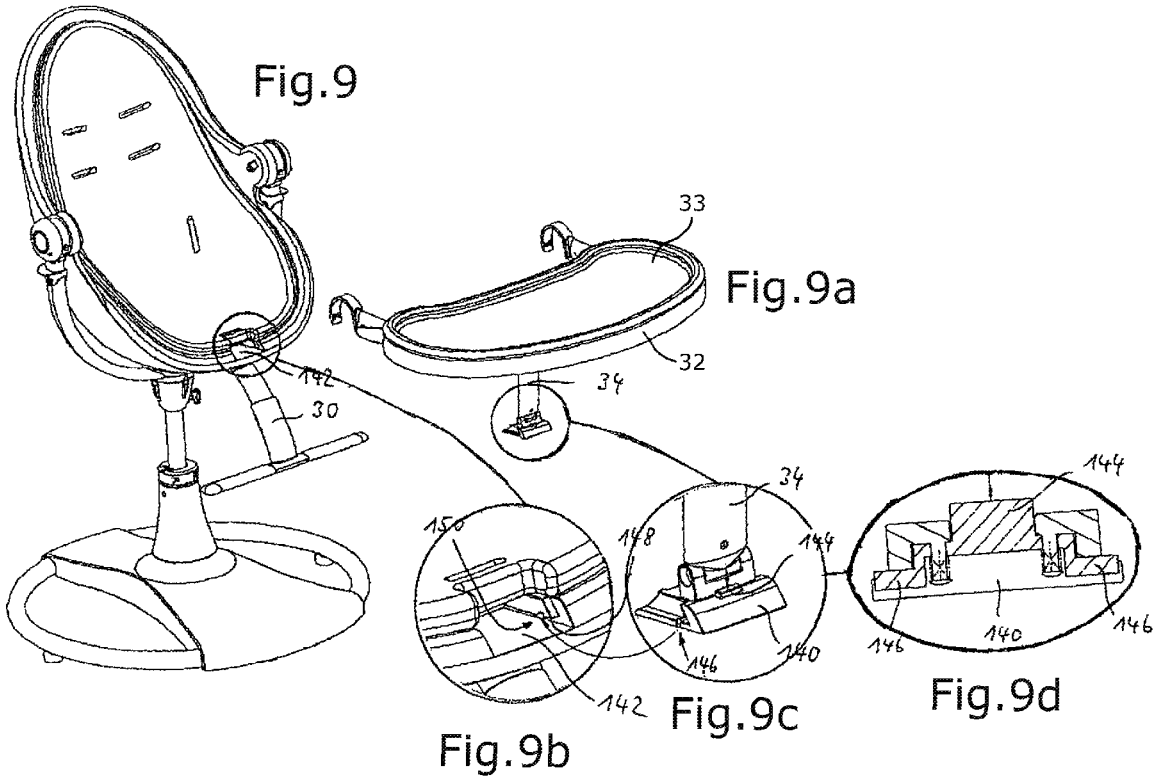
FIG. 9 and FIGS. 9*a* to 9*d* illustrate the fixing of a safety support to the seat element.

FIG. 9 and FIG. 9*a* to FIG. 9*d* illustrate the fixing of the safety support 34, which can be fixed with a snap-in foot 140 in a latching recess 142 of the seating shell. As FIG. 9*d* shows, a spring-preloaded pushbutton element 144 is provided, which is locked in the illustrated starting position and protrudes from the snap-in foot 140 with two lateral end sections 146. An approach bevel 148 in the latching recess 142 designed with a latching depression 150 arranged behind it enables automatic locking of the snap-in foot 140 when pushed into the latching recess 142. Pressing down on the pushbutton element 144 loosens the end sections 146 from the latching depressions 150, and the snap-in foot 140 can be withdrawn from the latching recess 142.

Since the table 32 remains horizontal independently of the respectively set angle of inclination of the seating shell, the safety support 34 is appropriately designed to move lengthways, achieved by a telescopic structure. Alternatively, an elastic material could be provided.

The footrest 30 is likewise designed to shift lengthways, appropriately by two mutually engaging, telescopically displaceable parts. Here also, clamping or snap-in means can be effective for fixing a selected length.

The features of the invention disclosed in the above description, in the claims and in the drawings can in their different embodiments be present both individually and in any combination required in order to realise the invention.

While illustrative embodiments have been illustrated and described, it will be appreciated that various changes can be made therein without departing from the spirit and scope of the invention.

What is claimed is:

1. A highchair with a foot part and a seat element mounted thereon, wherein a length-adjustable gas-filled strut for support and height adjustment of the seat element is provided between the foot part and the seat element, wherein the gas-filled strut is length adjustable with two-handed safety operation and wherein the seat element is held on two lateral support arms, on each of which an actuating element of the two-handed safety operation is arranged.

2. The highchair as claimed in claim 1, wherein the gas-filled strut is a single vertically-arranged length-adjustable gas-filled strut.

3. The highchair as claimed in claim 1, wherein each actuating element is connected via a wire or rope pull to a pressure element acting on an actuating projection of the gas-filled strut.

4. The highchair as claimed in claim 1, wherein a table is held horizontally on the lateral support arms, whereby a telescopic safety support is arranged to shift lengthways between a leading edge of the seat element and the table.

5. The highchair as claimed in claim 4, wherein the safety support is held on the seat element by a fixing mechanism detachable by hand.

6. The highchair as claimed in claim 5, wherein the fixing mechanism is formed by a snap-in connection detachable by means of pressure actuation.

7. The highchair as claimed in claim 4, wherein the table is detachably held with two snap-in fixing catches on the support arms.

8. The highchair as claimed in claim 1, wherein a table is held detachably and horizontally on the lateral support arms.

9. The highchair as claimed in claim 8, wherein a substitute table top is snapped in detachably on the table.

10. A highchair with a foot part and a seat element mounted thereon, wherein a length-adjustable gas-filled strut for support and height adjustment of the seat element is provided between the foot part and the seat element, wherein the seat element is pivotable and fixable about a horizontal transverse axis forwards and backwards in a tilting position and wherein the seat element is swivel-mounted on two lateral support arms about the transverse axis, whereby an inclination catch is provided on at least one support arm.

11. The highchair as claimed in claim 10, wherein the inclination catch has a rotary locking element acting between a spindle of the seat element and a support arm, which is transferable into a locking or release position by means of an actuation cam.

12. The highchair as claimed in claim 11, wherein the rotary locking element cooperates with the spindle in a torque-proof manner and shifts longitudinally via a longitudinal groove or wedge teeth, and has radially or axially aligned locking teeth that are engageable with corresponding locking teeth connected solidly to the support arm.

13. The highchair as claimed in claim 11, wherein an actuating element is arranged on a rear side of the seat element and is connected to a wire or rope pull cooperating with the actuation cam.

14. The highchair as claimed in claim 10, wherein a table is held horizontally on the lateral support arms, whereby a telescopic safety support is arranged to shift lengthways between a leading edge of the seat element and the table.

15. The highchair as claimed in claim 14, wherein the safety support is held on the seat element by a fixing mechanism detachable by hand.

16. The highchair as claimed in claim 15, wherein the fixing mechanism is formed by a snap-in connection detachable by means of pressure actuation.

17. The highchair as claimed in claim 14, wherein the table is detachably held with two snap-in fixing catches on the support arms.

18. The highchair as claimed in claim 1 or 10, wherein the seat element is rotatable and fixable about a vertical axis relative to the foot part.

19. The highchair as claimed in claim 18, wherein the seat element is rotatable through 360°.

20. The highchair as claimed in claim 18, wherein a cylindrical lifting lug of the seat part is held in a hollow-cylindrical recess of the foot part.

21. The highchair as claimed in claim 20, wherein the recess is provided with a C-shaped clamp ring enclosing the lifting lug.

22. The highchair as claimed in claim 1 or 10, wherein a height-adjustable footrest is held on the seat part.

23. The highchair as claimed in claim 10, wherein a table is held detachably and horizontally on the lateral support arms.

24. The highchair as claimed in claim 23, wherein a substitute table top is snapped in detachably on the table.

25. The highchair as claimed in claim 1 or 10, wherein the foot part has an annular part with a central transverse element on which the seat element is held.

26. The highchair as claimed in claim 25, wherein the transverse element has a hollow-cylindrical recess for a lifting lug of the seat element.

27. The highchair as claimed in claim 10, wherein the foot part has an annular part with a central transverse element on which the seat element is held and wherein the transverse element has a hollow-cylindrical recess for a gas-filled strut.

28. A highchair with a foot part and a seat element mounted thereon, wherein the seat element is pivotable and fixable about a horizontal transverse axis forwards and backwards in a tilting position, wherein the seat element is pivotally mounted on two lateral support arms about the transverse axis, whereby an inclination catch is provided on at least one support arm of the two lateral support arms, the inclination catch having a rotary locking element acting between a spindle of the seat element and the at least one support arm, which rotary locking element is transferable into a locking or release position by an actuation cam, and wherein a table is held detachably and horizontally on the lateral support arms.

29. The highchair as claimed in claim 28, wherein an actuating element is arranged on a rear side of the seat element and is connected to a wire or rope pull cooperating with the actuation cam.

30. The highchair as claimed in claim 28, wherein the rotary locking element cooperates with the spindle in a torque-proof manner and shifts longitudinally via a longitudinal groove or wedge teeth, and has radially or axially aligned locking teeth that are engageable with corresponding locking teeth connected solidly to the at least one support arm.

31. The highchair as claimed in claim 28, wherein a table is held horizontally on the lateral support arms, whereby a telescopic safety support is arranged to shift lengthways between a leading edge of the seat element and the table.

32. The highchair as claimed in claim 31, wherein the safety support is held on the seat element by a fixing mechanism detachable by hand.

33. The highchair as claimed in claim 32, wherein the fixing mechanism is formed by a snap-in connection detachable by means of pressure actuation.

34. The highchair as claimed in claim 31, wherein the table is detachably held with two snap-in fixing catches on the support arms.

35. The highchair as claimed in claim 28, wherein a substitute table top is snapped in detachably on the table.

36. The highchair as claimed in claim 28, wherein the foot part has an annular part with a central transverse element on which the seat element is held.

37. The highchair as claimed in claim 36, wherein the transverse element has a hollow-cylindrical recess for a lifting lug of the seat element.

38. The highchair as claimed in claim 28, wherein the seat element is rotatable and fixable about a vertical axis relative to the foot part.

39. The highchair as claimed in claim 38, wherein the seat element is rotatable through 360°.

* * * * *